US007748948B2

(12) United States Patent
Yokoyama et al.

(10) Patent No.: US 7,748,948 B2
(45) Date of Patent: Jul. 6, 2010

(54) VORTEX-FLOW BLOWER DEVICE

(75) Inventors: Shinichi Yokoyama, Gifu (JP); Kunihiro Tsuzuki, Obu (JP); Masaki Sakata, Kariya (JP)

(73) Assignee: Denso Corporation, Kariya (JP)

( * ) Notice: Subject to any disclaimer, the term of this patent is extended or adjusted under 35 U.S.C. 154(b) by 745 days.

(21) Appl. No.: 11/639,347

(22) Filed: Dec. 15, 2006

(65) Prior Publication Data

US 2007/0147983 A1 Jun. 28, 2007

(30) Foreign Application Priority Data

Dec. 26, 2005 (JP) ..... 2005-373100

(51) Int. Cl.
*F01D 21/04* (2006.01)
*F01D 21/12* (2006.01)
*F01B 25/00* (2006.01)

(52) U.S. Cl. ..... 415/9; 415/55.1; 415/144

(58) Field of Classification Search ..... 415/9, 415/47, 55.1–55.7, 144
See application file for complete search history.

(56) References Cited

U.S. PATENT DOCUMENTS 1,797,293 A * 3/1931 McIlvaine ..... 49/39
4,247,246 A * 1/1981 Abe et al. ..... 415/55.1
4,494,908 A * 1/1985 Hopfensperger ..... 415/206
4,899,777 A * 2/1990 Stone et al. ..... 137/74
4,935,717 A * 6/1990 Osawa et al. ..... 338/51
5,690,475 A * 11/1997 Yamada et al. ..... 417/32
5,770,993 A * 6/1998 Miyazawa et al. ..... 337/160
7,077,622 B2 * 7/2006 Ehrhard et al. ..... 415/9
7,281,897 B2 * 10/2007 Ochiai et al. ..... 416/184
2005/0047903 A1 3/2005 Yasuda et al.

* cited by examiner

*Primary Examiner*—Edward Look
*Assistant Examiner*—Sean J Younger
(74) *Attorney, Agent, or Firm*—Nixon & Vanderhye PC

(57) ABSTRACT

A vortex-flow blower device includes an impeller having a plurality of fins, a blower housing that has a vortex flow chamber for accommodating the impeller and extends from a start point on a side of a the fluid inlet port to an end point on a side of a fluid discharge port along the plurality of fins, a partitioning portion that blocks a communication between the end point and the start point in the vortex flow chamber, and a thermal fuse that is provided in the blower housing. The thermal fuse can be fused by a temperature rise so as to discharge the fluid on the side of the fluid discharge port to an outside, or communicate with the side of the fluid discharge port to the side of the fluid inlet port in the vortex flow chamber when the thermal fuse is fused.

13 Claims, 5 Drawing Sheets

VORTEX-FLOW BLOWER DEVICE

CROSS REFERENCE TO RELATED APPLICATION

This application is based on Japanese Patent Application No. 2005-373100 filed on Dec. 26, 2005, the contents of which are incorporated herein by reference in its entirety.

FIELD OF THE INVENTION

The present invention relates to a vortex-flow blower device. For example, the vortex-flow blower device can be suitably used for an electric air pump of a secondary air supply system that supplies air to a three-way catalyst converter of a vehicle with pressure.

BACKGROUND OF THE INVENTION

As an example of a vortex-flow blower device, there are known electric air pumps used in secondary air supply systems or the like. (Refer to JP-A-2005-69127 corresponding to US 2005/0047903 A1, for example.)

In the secondary air supply systems, when an engine has been just started and the temperature of its three way catalyst converter is low, air (secondary air), produced by operating an electric air pump, is guided to the three-way catalyst converter for purifying exhaust gas, and a three-way catalyst is thereby activated.

As illustrated in FIG. 5, a typical electric air pump used for secondary air supply systems includes: a resin impeller 101 having multiple fins 101*a*; a blower housing 104 having a vortex flow chamber 102 that covers the impeller 101 and a partitioning portion 103 that separates the discharge port side and the inlet port side of the vortex flow chamber 102 from each other; and an electric motor that rotationally drives the impeller 101.

When a driving relay for operation is turned on, the electric motor rotationally drives the impeller 101 in the electric air pump. When the impeller 101 is rotated, the air in the vortex flow chamber 102 is compressed from the vortex start point side to the vortex end point side by the movement of a large number of fins 101*a*. Since negative pressure is produced on the start point side of the vortex flow chamber 102, air is guided into the inlet port. Since high pressure is produced on the vortex end point side of the vortex flow chamber 102, pressurized secondary air is discharged from the discharge port and the discharged secondary air is guided into an exhaust pipe positioned upstream of the three way catalyst converter.

When the discharge side of the electric air pump is closed, the pressure in the blower housing 104 is raised, and the temperature in the blower housing 104 is raised. Even in this state, temperature rise can be suppressed within a normal temperature range for a predetermined control time, and thus any problem does not arise normally.

However, when the driving relay of the electric air pump is locked in on state, a harness for bypassing the driving relay is short-circuited, or any other like events for some unexpected reason are assumed as failure in the secondary air supply system, a problem arises. When the electric air pump operates for a time longer than a predetermined control time when the discharge side of the electric air pump is closed, the internal temperature of the blower housing 104 rises beyond the normal temperature range. As a result, the impeller 101 is thermally expanded by high-temperature air and the impeller 101 is brought into contact with the partitioning portion 103 of the blower housing 104. Then, the resin melted in the partitioning portion 103 gets caught in the impeller 101 and the impeller 101 is locked. As the result of the impeller 101 being locked, the impeller 101 may burst.

When the blower housing 104 is made of resin, the blower housing 104 can also be broken by the bursted impeller 101. Furthermore, when the blower housing 104 is broken, the broken blower housing 104 is supplied with the turning force of the impeller 101, and the broken pieces of the blower housing 104 may fly in all directions.

SUMMARY OF THE INVENTION

The invention has been made with the above-problems taken into account, and an object of the invention is to provide a vortex-flow blower device, which can effectively prevent an impeller.

According to an aspect of the present invention, a vortex-flow blower device includes: an impeller having a plurality of fins; a blower housing that has a fluid inlet port for introducing a fluid therein, a fluid outlet port for discharging the fluid, and a vortex flow chamber that accommodates the impeller and extends from a vortex start point on a side of the fluid inlet port to a vortex end point on a side of the fluid discharge port along the plurality of fins; a partitioning portion that blocks a communication between the vortex end point and the vortex start point in the vortex flow chamber; and a thermal fuse that is provided in the blower housing.

In the vortex-flow blower device, the thermal fuse is fused by a temperature rise so as to discharge the fluid on the side of the discharge port to an outside when the thermal fuse is fused. Alternatively, the thermal fuse is fused by a temperature rise such that the side of the discharge port communicates with the side of the inlet port in the vortex flow chamber when the thermal fuse is fused. Alternatively, the thermal fuse is fused by a temperature rise to be opened. Accordingly, when a state in which discharge load is high is maintained for a long time and the internal temperature of the blower housing rises, the thermal fuse of resin provided in the blower housing is fused and the fluid on the discharge port side can be discharged, thereby the discharge load can be reduced.

Thus, a temperature rise in the blower housing can be effectively controlled, and it is possible to prevent thermal expansion of the impeller and avoid locking of the impeller. Since locking of the impeller is avoided as mentioned above, the impeller can be prevented from being bursted.

Even when the blower housing is made of resin, its breakage is avoided because bursting of the impeller does not occur. Since breakage of the blower housing is avoided, the broken pieces of the blower housing do not fly in all directions.

For example, the thermal fuse may be provided in the partitioning portion adjacent to the discharge port. Alternatively, the impeller may be deformed by the temperature rise in the blower housing to contact the blower housing at a position close to the thermal fuse or contact the thermal fuse such that the thermal fuse is fused by the temperature rise.

Furthermore, the thermal fuse may be a thin wall portion integrally molded in the blower housing made of resin. Alternatively, the thermal fuse may be a thin wall portion provided in the partitioning portion made of a resin. In this case, the partitioning portion has a recess portion recessed from an outer wall surface of the partitioning portion to form the thermal fuse.

BRIEF DESCRIPTION OF THE DRAWINGS

Additional objects and advantages of the present invention will be more readily apparent from the following detailed description of preferred embodiments when taken together with the accompanying drawings. In the drawings.

DETAILED DESCRIPTION OF THE PREFERRED EMBODIMENTS

First Embodiment

Description will be given to a first embodiment, in which the invention is typically applied to an electric air pump of a secondary air supply system, with reference to FIGS. 1A and 1B and FIG. 2.

First, description will be given to an electric air pump with reference to FIG. 2.

The electric air pump is constructed so as to compress and discharge air when energized. The electric air pump is a supercharger that supplies pressurized secondary air to an area positioned upstream of a catalyst for purifying exhaust gas, mounted in an automobile.

Figure 2:
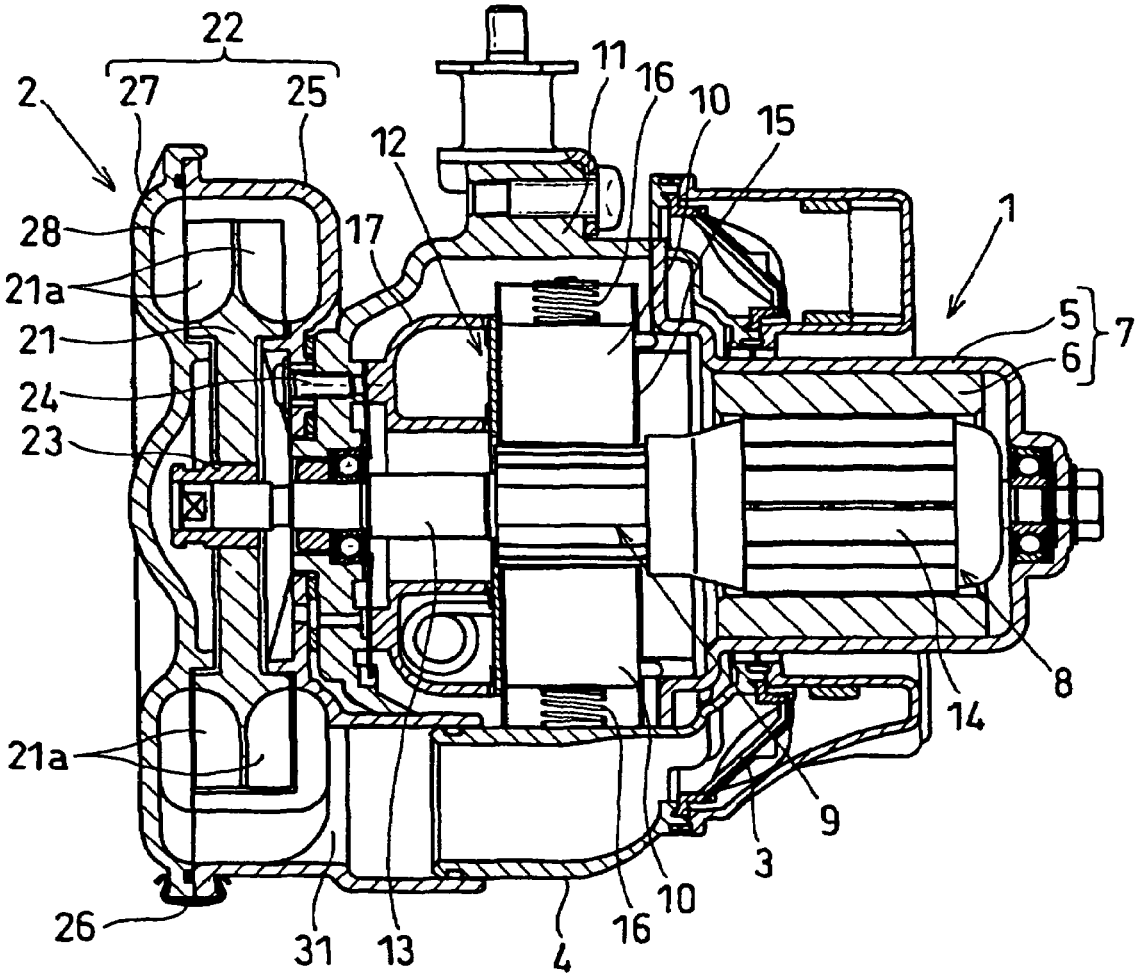
FIG. 2 is a schematic sectional view of an electric air pump according to the first embodiment.

As illustrated in FIG. 2, the electric air pump in the first embodiment is constructed of an electric motor 1, a vortex flow blower 2, and an air duct 4 with a filter 3 incorporated in it.

The electric motor 1 shown in the drawing of the first embodiment is a direct-current motor (DC motor). The electric motor 1 is constructed of: a field (stator) 7 constructed by placing multiple magnets 6 on the inner circumferential surface of a cylindrical yoke 5; an armature (rotor) 8 placed inside the field 7; a brush assembly 12 formed by placing multiple brushes 10, abutted against the commutators 9 provided in the armature 8, in a motor housing 11; and the like.

The armature 8 is constructed of: a rotating shaft 13 rotatably supported in the electric motor 1; an armature core 14 fixed on the outer circumferential surface of the rotating shaft 13; multiple armature coils wound on the armature core 14; the multiple commutators 9 connected to the armature coils; and the like.

The brush assembly 12 is constructed of: the brushes 10 pressed against the commutators 9; a brush holding member 15 that slidably holds the brushes 10 toward the commutators 9; springs 16 that bias the brushes 10 toward the commutators 9; a spacer 17 that supports the brush holding member 15 in the motor housing 11; and the like.

The blower 2 shown in the drawing of the first embodiment is of double-sided and vortex flow type, and is constructed of a resin impeller 21 and a resin blower housing 22.

The impeller 21 is substantially in disk shape and is provided with a large number of fins 21*a* at its outer radius portion on both sides. With the center of the disk portion coupled with an end of the rotating shaft 13 of the electric motor 1 through a coupling means 23, the impeller 21 is rotated integrally with the rotating shaft 13.

The blower housing 22 is constructed of: a first case (main blower housing) 25 coupled with the motor housing 11 by a screw 24; and a second case (cover) 27 coupled with the first case 25 by a clip 26.

Figure 1A:
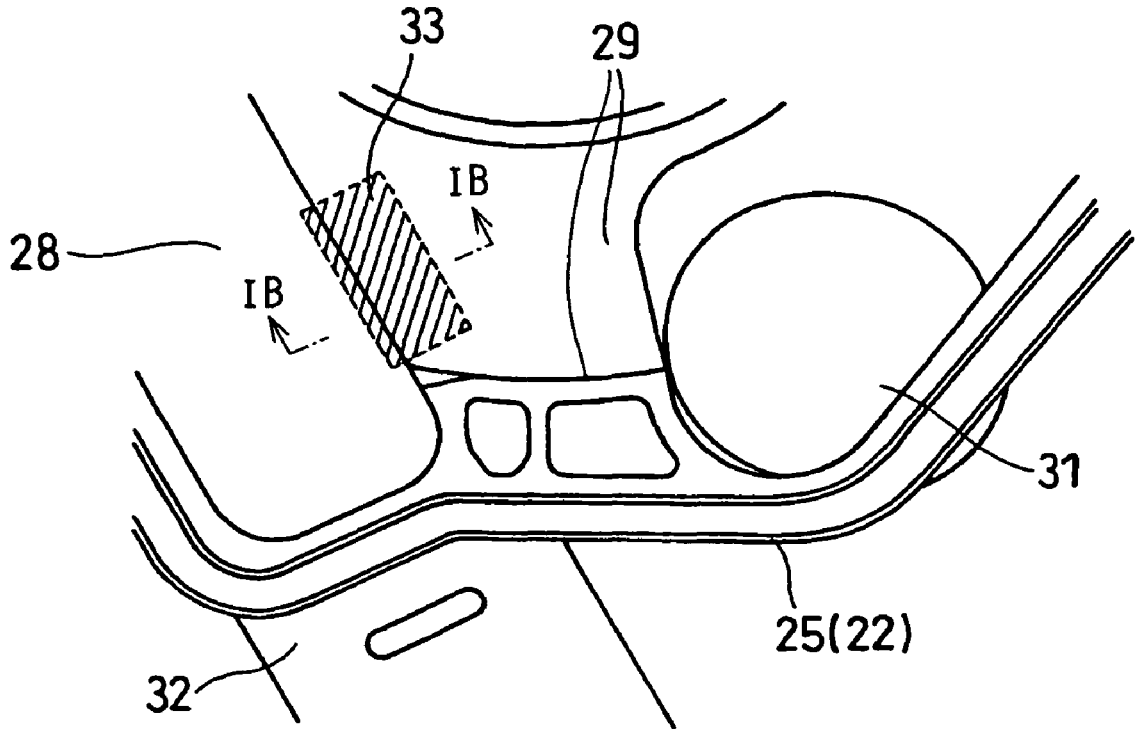
FIGS. 1A and 1B are respectively a plan view illustrating a part of a blower housing, and a sectional view taken along the line IB-IB of FIG. 1A according to a first embodiment of the present invention.
Figure 1B:
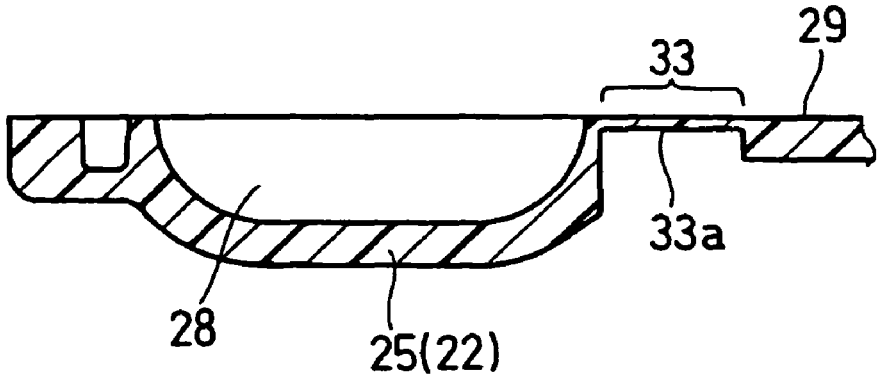

In the blower housing 22, as illustrated in FIGS. 1A and 1B, there are provided a vortex flow chamber 28 and a partitioning portion 29. The vortex flow chamber 28 is for compressing air by the movement of a large number of the fins 21*a* caused by the rotation of the impeller 21. The partitioning portion 29 blocks the communication between the inlet port side and the discharge port side of the vortex flow chamber 28 at some midpoint in the direction of rotation.

The vortex flow chamber 28 is substantially in C shape (the shape of circle part of which is cut off) in the direction of rotation of the impeller 21, and forms a space in which air flows, around its portion provided with a large number of the fins 21*a*.

The vortex flow chamber 28 is provided at its start point (the area where each fin 21*a* starts to enter the vortex flow chamber 28) with an inlet port 31 for guiding external air into the vortex flow chamber 28. As illustrated in FIG. 2, this inlet port 31 communicates with the downstream end of the air duct 4.

The vortex flow chamber 28 is provided at its end point (the area where each fin 21*a* gets out of the vortex flow chamber 28) with a discharge port 32 for discharging air compressed in the vortex flow chamber 28 to the outside.

When a driving relay is turned on by an engine control unit (ECU), not shown, and the electric motor 1 of the electric air pump constructed as mentioned above is connected to an in-vehicle battery, the impeller 21 is rotated together with the rotating shaft 13.

When the impeller 21 is rotated, air in the vortex flow chamber 28 is compressed from the start point side to the end point side by the movement of a large number of the fins 21*a*. Since negative pressure is produced at the inlet port 31, air filtered through the filter 3 is guided into the inlet port 31. Further, since high pressure is produced at the discharge port 32, air compressed in the vortex flow chamber 28 is discharged from the discharge port 32.

When the discharge side of the electric air pump is closed during its operation, the pressure in the blower housing 22 is raised, and the temperature in the blower housing 22 rises. Even in this state, temperature rise can be suppressed within a normal temperature range for a predetermined control time, and thus any problem does not arise at all.

However, when the driving relay is locked in on state for some unexpected reason and the electric air pump operates for a time longer than the predetermined control time with the discharge side of the electric air pump closed, a problem may arise. The internal temperature of the blower housing 22 rises beyond the normal temperature range. As a result, the impeller 21 may be thermally expanded by high-temperature air and the impeller 21 may be brought into contact with the partitioning portion 29 of the blower housing 22. Then, the resin melted at the partitioning portion 29 gets caught in the impeller 21 and the impeller 21 is locked. As the result of the impeller 21 being locked, the impeller 21 made of resin bursts.

When the blower housing 22 is made of resin, as in the first embodiment, the blower housing 22 can be broken by bursting of the impeller 21 at this time. When the blower housing 22 is broken, the broken blower housing 22 is supplied with the turning force of the impeller 21, and the broken pieces of the blower housing 22 fly in all directions.

To avoid the above-mentioned problem, the first embodiment takes the following measure: The blower housing 22 is provided at its temperature-rise portion on the discharge side with a thin resin thermal fuse 33 (the hatched portion in FIG. 1A). When the temperature rises, this thermal fuse 33 is fused to let air on the discharge port 32 side of the vortex flow chamber 28 out of the blower housing 22.

More specific description will be given. The temperature rising portion in the blower housing 22 where the temperature rises is the portion that is positioned on the side of the vortex flow chamber 28 close to the discharge port 32 (the portion where the temperature rises due to pressurization) and where each fin 21*a* enters the partitioning portion 29. In the temperature rising portion, the temperature is raised by air attrition produced when each fin 21*a* enters the partitioning portion 29, and the temperature is raised by each fin 21*a* being brought into contact with the partitioning portion 29 by thermal expansion of the impeller 21.

In this embodiment, the thermal fuse 33 is provided in the side face of the partitioning portion 29, close to the discharge port 32 as illustrated in FIG. 1A.

In the first embodiment, the thermal fuse 33 is provided by forming a thin wall portion in the side face of the partitioning portion 29 close to the discharge port 32, when the blower housing 22 (first case 25 or second case 27) is molded. That is, the thermal fuse 33 in the first embodiment is a thin portion that is, when the blower housing 22 is molded, integrally molded of the same resin as for the blower housing. As illustrated in FIG. 1B, it is thinned by providing a recessed portion 33*a* in the outer surface of the blower housing 22 (e.g., first case 25 in the drawing).

FIG. 1A illustrates an example in which the thermal fuse 33 is provided in the first case 25 (e.g., main blower housing 22). Instead, the thermal fuse 33 may be provided in the second case (i.e., cover) 27 that can be easily attached, detached, and replaced for ease of maintenance, or may be provided in both the first and second cases 25 and 27. Provision of the thermal fuse 33 in both the first and second cases 25 and 27 makes it possible to more reliably fuse the thermal fuse 33 by temperature rise.

In the electric air pump in the first embodiment, the following can be implemented when the driving relay is locked in on state, a harness is short-circuited, or any other like event occurs for some unexpected reason. For example, when the electric air pump operates for a time longer than the predetermined control time with the discharge side of the electric air pump, the internal temperature of the blower housing 22 rises. Then, the thin resin thermal fuse 33 provided in the side face (temperature rising portion of the blower housing 22) of the partitioning portion 29 close to the discharge port 32 is fused. As a result, the discharge side of the vortex flow chamber 28 and the outside are allowed to communicate with each other by the thermal fuse 33 (hole), and pressurized air on the discharge port 32 side is let out.

Thus, the discharge load in the vortex flow chamber 28 is reduced; therefore, the temperature in the blower housing 22 is lowered, and this makes it possible to prevent thermal expansion of the impeller 21 and avoid locking of the impeller 21. Since locking of the impeller 21 is avoided as mentioned above, bursting of the impeller 21 can be prevented.

Even when the blower housing 22 is made of resin, bursting of the impeller 21 does not occur, as mentioned above, and breakage of the blower housing 22 is avoided, and thereby the broken pieces of the blower housing 22 do not fly in all directions.

As mentioned above, the thermal fuse 33 in the first embodiment is formed by reducing the wall thickness of the side face (side part) of the partitioning portion 29 in the blower housing 22, close to the discharge port 32. It is molded integrally with the resin blower housing 22. Therefore, the number of parts of the electric air pump is not increased even by provision of the thermal fuse 33. This prevents increase in cost due to provision of the thermal fuse 33.

The thermal fuse 33 may be provided by forming a hole in the blower housing 22 (first case 25 or second case 27) and by closing the hole with a thin resin member. In this case, because the thermal fuse 33 is made of a separate member, it is possible to easily change the setting of fusing temperature of the thermal fuse 33.

Second Embodiment

Description will be given to a second embodiment with reference to FIGS. 3A and 3B. In the following description of the second embodiment, the same reference numerals as in the description of the first embodiment denote the same functional elements as in the first embodiment.

In the above example described with respect to the first embodiment, the thermal fuse 33 is provided in the side face (side part) of the partitioning portion 29, close to the discharge port 32.

In the second embodiment, the thermal fuse 33 is provided in the partitioning portion 29 between the discharge port 32 and the inlet port 31. It is fused by temperature rise, and thereby allows the discharge port 32 side of the vortex flow chamber 28 and the inlet port 31 side of the vortex flow chamber 28 to communicate with each other.

In the second embodiment, specifically, the thermal fuse 33 is provided in the outer portion of the partitioning portion 29 in the radial direction.

Figure 3A:
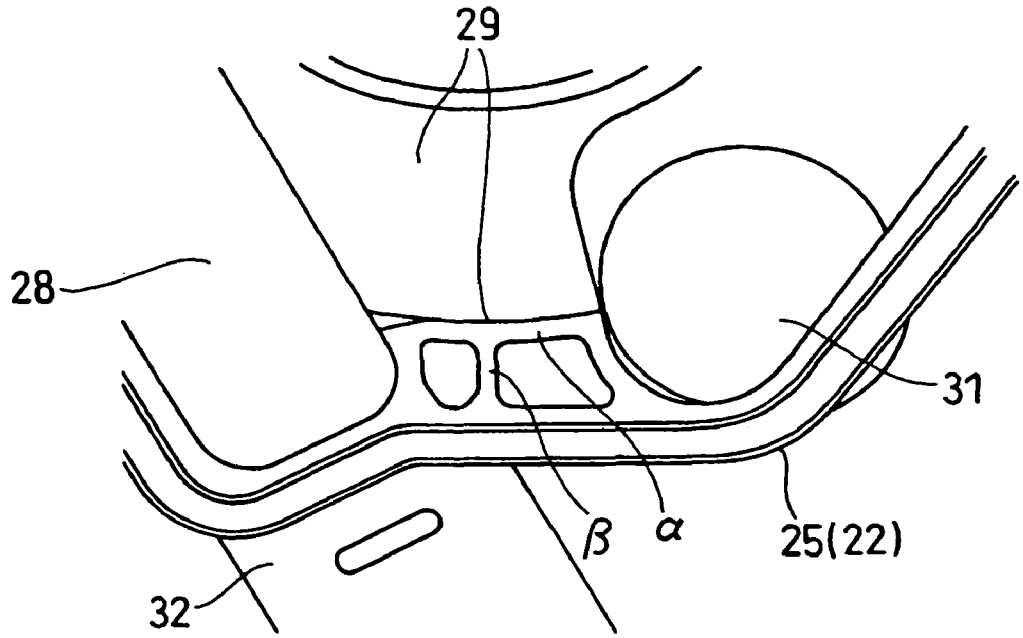
FIG. 3A is a plan view showing a part of a blower housing in a comparative example.

FIG. 3A illustrates a comparative example of the outer portion of the partitioning portion 29 in the radial direction. The outer portion of the partitioning portion 29 in the radial direction according to the comparative example is robust. The thickness $\alpha$ of the outer portion opposed to the peripheral edges of the fins 21*a* is large, and this outer portion in the radial direction having the thickness $\alpha$ is provided with a reinforcing rib $\beta$.

Figure 3B:
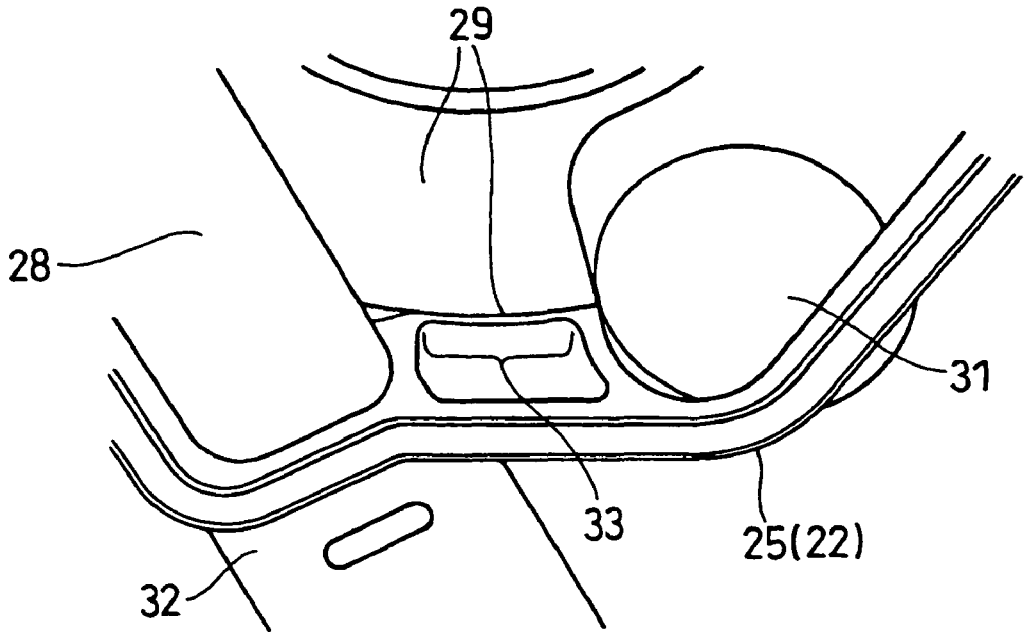
FIG. 3B is a plan view showing a part of a blower housing according to a second embodiment of the present invention.

In the second embodiment, meanwhile, the outer portion of the partitioning portion 29 in the radial direction is so constructed that the following is implemented: as illustrated in FIG. 3B, the thickness $\alpha$ of the outer portion opposed to the peripheral edges of the fins 21*a* is reduced; the reinforcing rib $\beta$ in the outer portion in the radial direction having the thickness $\alpha$ is disused; and the thermal fuse 33 is formed with a reduced thickness $\alpha$.

In the second embodiment, the thermal fuse 33 is provided. Accordingly, in a state where the above-mentioned driving relay is locked in on state, a harness is short-circuited or any other like event occurs for some unexpected reason, when the electric air pump operates for a time longer than the predetermined control time with the discharge side of the electric air pump closed and the internal temperature of the blower housing 22 rises, the thin resin thermal fuse 33 provided in the partitioning portion 29 between the discharge port 32 and the inlet port 31 is fused. This returns air on the discharge port 32 side to the inlet port 31 side.

Thus, the discharge load can be reduced; and therefore, the temperature in the blower housing 22 is lowered, and the same effect as in the first embodiment can be obtained.

Third Embodiment

Description will be given to a third embodiment with reference to FIG. 4.

With the constructions of the electric air pumps in the first and second embodiments, the following problem may arise when the outdoor air temperature is low in a winter season even when the internal temperature of the blower housing 22 rises. That is, the thermal fuse 33 may be not softened because of outdoor air temperature even when the internal temperature of the blower housing 22 rises.

To cope with this, the impeller 21 in the third embodiment is so provided that when the temperature in the blower housing 22 rises, the impeller 21 is deformed and is positively brought into contact with the blower housing 22. The blower housing 22 is provided at or in proximity to its portion in contact with the impeller 21 with the thin resin thermal fuse 33. When the temperature rises, this thermal fuse 33 is fused to let out fluid on the discharge port 32 side or allows the discharge port 32 side and the inlet portion 31 side to communicate with each other. In the third embodiment, specifically, the thermal fuse 33 can be provided at the portion indicated in the description of the first embodiment. (Refer to FIGS. 1A and 1B.)

For deforming the impeller 21 by temperature rise in the blower housing 22, the impeller 21 is deformed to the side on which the thermal fuse 33 is provided (in the axial direction in which the electric motor 1 is placed) by the centrifugal force of the impeller 21, and the fins 21*a* are thereby brought into contact with the area where the thermal fuse 33 is provided.

Thus, when the temperature of the vortex flow chamber 28 is within a normal range, the fins 21*a* are not brought into contact with the blower housing 22; and when the temperature of the vortex flow chamber 28 rises beyond the normal range, the fins 21*a* are brought into contact with the area where the thermal fuse 33 is provided. As a result, frictional heat arising from contact with the thermal fuse 33 is supplied, and fusing of the thermal fuse 33 is facilitated.

More specific description will be given. In this embodiment, the following is implemented as a means for deforming the impeller 21 to the side on which the thermal fuse 33 is provided (i.e., in the axial direction in which the electric motor 1 is placed) by the centrifugal force of the impeller 21. That is, as illustrated in FIG. 4, the axial center I of the impeller 21 on the inner radius side and the axial center II of the impeller 21 on the outer radius side are deviated and offset from each other in the axial direction. Thus, the outer radius side of the impeller 21 is deformed toward the side on which the thermal fuse 33 is provided (i.e., in the axial direction in which the electric motor 1 is placed) by centrifugal force.

Figure 4:
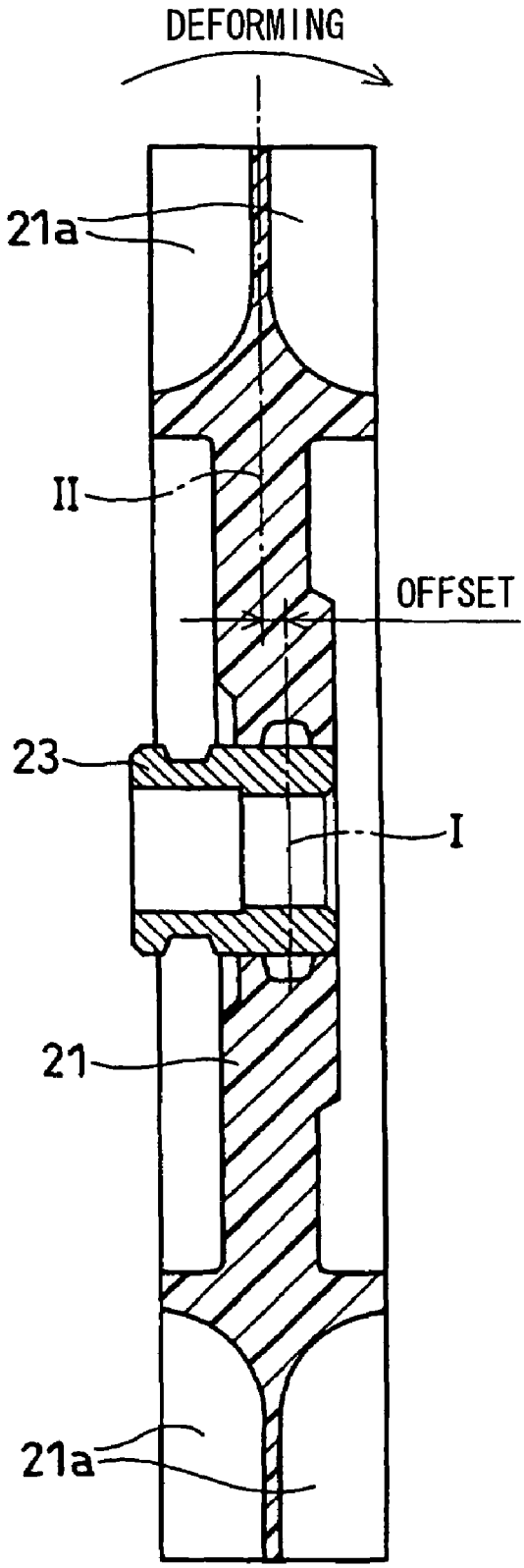
FIG. 4 is a sectional view of an impeller according to a third embodiment of the present invention.
Figure 5:
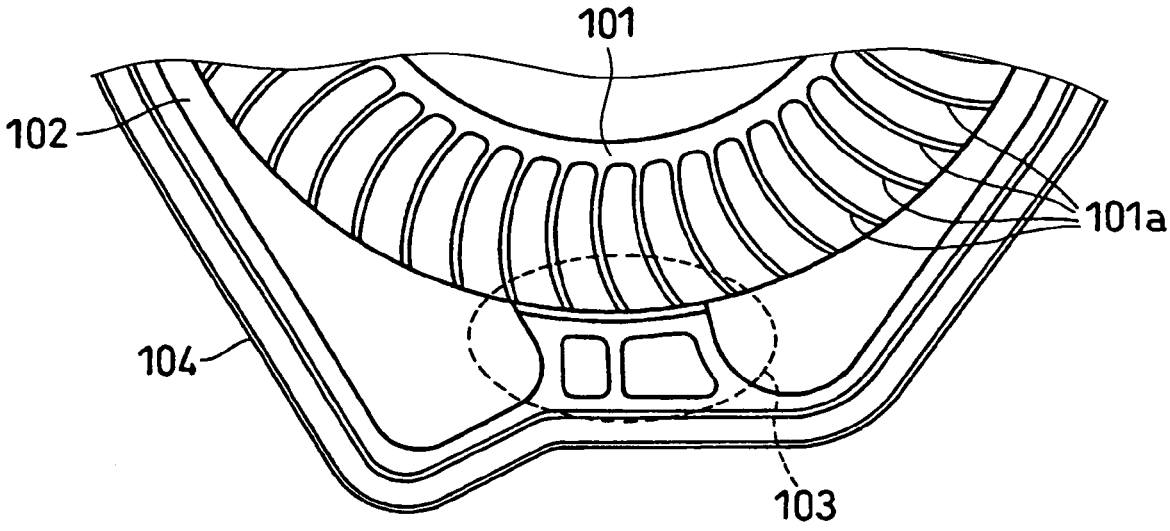
FIG. 5 RELATED ART
FIG. 5 is a plan view illustrating a part of an electric air pump in a related art.

The means for deforming the impeller 21 illustrated in FIG. 4 is just an example, and some other means (structure) may be used to deform the impeller 21. Specifically, for example, the following means may be adopted to break down the balance between the front side and the back side of the impeller 21: it is so formed that it is thicker on either front side or back side; the number of fins 21*a* is made different between the front side and the back side; the fine 21*a* on the front side and on the back side are made different from each other in shape (angle of inclination, or the like); and the fins 21 on the front side and on the back side are made different from each other in fin width.

In the electric air pump in the third embodiment, as mentioned above, the impeller 21 is so provided that the impeller 21 is deformed by temperature rise in the blower housing 22 and is brought into contact with the blower housing 22.

Thus, even when the external temperature of the blower housing 22 is low, because the impeller 21 is deformed and brought into contact with the blower housing 22 by centrifugal force when the inside temperature of the blower housing 22 is high for a time longer than a predetermined period, the temperature increase of the thermal fuse 33 is facilitated by frictional heat so as to fuse the thermal fuse 33.

As a result, when a state in which the discharge load is high maintains for a long time and the internal temperature of the blower housing 22 rises, the thermal fuse 33 can be accurately fused even when the outdoor air temperature is low. Therefore, the same effect as in the first embodiment can be obtained.

The third embodiment adopts such a construction that the impeller 21 is deformed by the centrifugal force (e.g., a force resulting from wind pressure, or the like) and is positively brought into contact with the blower housing 22. Therefore, even in an electric air pump in which the number of revolutions of its impeller 21 is low, the impeller 21 can be brought into contact with the blower housing 22, and fusing of the thermal fuse 33 can be facilitated when the inside temperature of the blower housing 22 is high for a time longer a predetermined time.

In the example described with respect to the third embodiment, the impeller 21 is softened by temperature rise in the blower housing 22 and is thereby brought into contact with the blower housing 23. Instead, the impeller 21 may be deformed by action (force) resulting from rotation (centrifugal force or the like) and be brought into contact with the blower housing 22 even when the temperature in the blower housing 22 is within a normal range. For example, when the driving relay is locked in on state and the electric air pump operates for a time longer than the predetermined control time, the thermal fuse 33 may be set to be positively fused by heating due to contact between the impeller 21 and the blower housing 22, regardless of the number of revolutions of the impeller 21.

Other Embodiments

Although the present invention has been fully described in connection with the preferred embodiments thereof with reference to the accompanying drawings, it is to be noted that various changes and modifications will become apparent to those skilled in the art.

For example, in any one of the above-described embodiments, the thermal fuse 33 may be provided to form an open when the thermal fuse 33 is fused. In this case, the same effects described above can be obtained.

In the examples described with respect to the above embodiments, the invention is applied to an electric air pump that pressurizes air and discharges the pressurized air. Instead, the invention may be applied to a vortex-flow blower device that pressurizes gas or the like other than air and discharges the pressurized gas. Further, the invention may be applied to a vortex-flow blower device that pressurizes gas-liquid mixture fluid in which gas and liquid (e.g., nebulized liquid) are mixed together and discharges the pressurized mixture fluid.

In the examples described with respect to the above embodiments, the vortex-flow blower device uses the double-sided impeller 21 (electric air pump in the embodiments). Instead, the invention may be applied to a vortex-flow blower device using an impeller 21 of single-side type. That is, the present invention may be applied to a vortex-flow blower device of such a type in which fins 21 without differences between the front side and the back side are used.

Such changes and modifications are to be understood as being within the scope of the present invention as defined by the appended claims.

What is claimed is:

1. A vortex-flow blower device comprising:

an impeller having a plurality of fins;

a blower housing that has a fluid inlet port for introducing a fluid therein, a fluid outlet port for discharging the fluid, and a vortex flow chamber that accommodates the impeller and extends from a vortex start point on a side of the fluid inlet port to a vortex end point on a side of the fluid outlet port along the plurality of fins;

a partitioning portion that blocks a communication between the vortex end point and the vortex start point in the vortex flow chamber; and a thermal fuse that is molded as an integral part of the blower housing from a common resin material, which is common to both the thermal fuse and a remainder of the blower housing, wherein:

the thermal fuse is configured as a recess that is recessed from a surface of an adjacent area of the blower housing, which is adjacent to the thermal fuse, so as to have a thin wall with a wall thickness that is less than a wall thickness of the adjacent area of the blower housing; and the thermal fuse is adapted to be fused by a temperature rise so as to discharge the fluid on the side of the outlet port to an outside when the thermal fuse is fused.

2. The vortex-flow blower device of claim 1, wherein the thermal fuse is provided in the partitioning portion adjacent to the outlet port.

3. The vortex-flow blower device of claim 1, wherein the impeller is made of resin, and the impeller is deformed by the temperature rise in the blower housing to contact the blower housing at a position close to the thermal fuse such that the thermal fuse is fused by the temperature rise.

4. The vortex-flow blower device of claim 1, wherein the impeller is made of resin, and the impeller is deformed by the temperature rise in the blower housing to contact the thermal fuse such that the thermal fuse is fused by the temperature rise.

5. A vortex-flow blower device comprising:

an impeller having a plurality of fins;

a blower housing that has a fluid inlet port for introducing a fluid therein, a fluid outlet port for discharging the fluid, and a vortex flow chamber that accommodates the impeller and extends from a vortex start point on a side of the fluid inlet port to a vortex end point on a side of the fluid outlet port along the plurality of fins;

a partitioning portion that blocks a communication between the vortex end point and the vortex start point in the vortex flow chamber; and a thermal fuse that is molded as an integral part of the blower housing from a common resin material, which is common to both the thermal fuse and a remainder of the blower housing, wherein:

the thermal fuse is configured as a recess that is recessed from a surface of an adjacent area of the blower housing, which is adjacent to the thermal fuse, so as to have a thin wall with a wall thickness that is less than a wall thickness of the adjacent area of the blower housing; and the thermal fuse is adapted to be fused by a temperature rise such that the side of the outlet port communicates with the side of the inlet port in the vortex flow chamber when the thermal fuse is fused.

6. The vortex-flow blower device of claim 5, wherein the thermal fuse is provided in the blower housing between the outlet port and the inlet port.

7. The vortex-flow blower device of claim 5, wherein the thermal fuse is provided in the partitioning portion at a position adjacent to the outlet port.

8. The vortex-flow blower device of claim 5, wherein the impeller is made of resin, and the impeller is deformed by the temperature rise in the blower housing to contact the blower housing at a position close to the thermal fuse such that the thermal fuse is fused by the temperature rise.

9. The vortex-flow blower device of claim 5, wherein the impeller is made of resin, and the impeller is deformed by the temperature rise in the blower housing to contact the thermal fuse such that the thermal fuse is fused by the temperature rise.

10. A vortex-flow blower device comprising:

an impeller having a plurality of fins;

a blower housing that has a fluid inlet port for introducing a fluid therein, a fluid outlet port for discharging the fluid, and a vortex flow chamber that accommodates the impeller and extends from a vortex start point on a side of the fluid inlet port to a vortex end point on a side of the fluid outlet port along the plurality of fins;

a partitioning portion that blocks a communication between the vortex end point and the vortex start point in the vortex flow chamber; and a thermal fuse that is molded as an integral part of the blower housing from a common resin material, which is common to both the thermal fuse and a remainder of the blower housing, wherein:

the thermal fuse is configured as a recess that is recessed from a surface of an adjacent area of the blower housing, which is adjacent to the thermal fuse, so as to have a thin wall with a wall thickness that is less than a wall thickness of the adjacent area of the blower housing; and the thermal fuse is adapted to be fused by a temperature rise to be opened.

11. The vortex-flow blower device of claim 1, wherein the thermal fuse is recessed from at an outer surface of the blower housing.

12. The vortex-flow blower device of claim 5, wherein the thermal fuse is recessed from at an outer surface of the blower housing.

13. The vortex-flow blower device of claim 10, wherein the thermal fuse is recessed from at an outer surface of the blower housing.

* * * * *